United States Patent [19]

Oberstein

[11] 3,936,890

[45] Feb. 10, 1976

[54] BIO-DISPOSABLE BAG-TYPE LINER FOR BEDPANS AND THE LIKE

[76] Inventor: Nathan Oberstein, 55 Knolls Crescent, Bronx, N.Y. 10463

[22] Filed: May 6, 1974

[21] Appl. No.: 467,609

[52] U.S. Cl. ..... 4/112; 4/142; 93/36.01

[51] Int. Cl.[2] ..... A61G 9/00; A47K 11/02

[58] Field of Search ..... 4/112, 111, 113, 143, 243, 4/114, 138, 141, 142; 93/84 R, 36.01

[56] References Cited

UNITED STATES PATENTS

| | | | |
|---|---|---|---|
| 2,866,980 | 1/1959 | Huntington | 4/142 |
| 3,546,716 | 12/1970 | Laumann | 4/112 |
| 3,605,127 | 9/1971 | Darley | 4/112 |
| 3,628,197 | 12/1971 | Leventhal et al. | 4/113 |

*Primary Examiner*—Richard E. Aegerter
*Assistant Examiner*—Steven L. Stephan
*Attorney, Agent, or Firm*—Clarence A. O'Brien; Harvey B. Jacobson

[57] ABSTRACT

A liner constructed of bio-degradable material in the form of a bag for use in combination with a bedpan, diaper or in any other location where a disposable bag-type liner is desired for receiving waste material where the waste material and the liner may be disposed of such as by flushing down a commode or the like. The bag-type liner includes a folded bag-like structure having a plurality of tabs on the open upper end thereof by which the open end of the bag may be secured to a bedpan or the like for maintaining the liner in position. The tabs are provided with adhesive material having a protector covering with the tabs facilitating unfolding of the bag-like liner and securement of the liner to the bedpan with the supporting ledge of the bedpan being covered by the liner and the tabs secured to the external surface of the bedpan.

5 Claims, 4 Drawing Figures

BIO-DISPOSABLE BAG-TYPE LINER FOR BEDPANS AND THE LIKE

BACKGROUND OF THE INVENTION

1. Field of the Invention

The present invention generally relates to a bedpan liner in the form of a bag constructed of bio-degradable material folded into a compact condition and readily expanded into the interior of the bedpan and secured in position by adhesive tabs with a portion of the liner overlying the occupant supporting flange of a conventional bedpan and the tabs secured to the external surface of the bedpan.

2. Description of the Prior Art

Bedpans with liners are known in various prior U.S. patents but such liners have been relatively difficult to assembly in relation to the bedpan or are difficult to remove therefrom and be disposed thereof, and in some instances require special bedpan structures to be used. The following U.S. patents disclose various types of bedpan and liner assemblies associated therewith: U.S. Pat. Nos, 1,067,423, issued Feb. 15, 1913; 1,086,584, issued Feb. 10, 1914; 1,954,684, issued Apr. 10, 1934; 2,523,452, issued Sept. 26, 1950; 3,377,631, issued Apr. 16, 1968; 3,484,874, issued Dec. 23, 1969; and, 3,605,127, issued Sept. 20, 1971.

SUMMARY OF THE INVENTION

An object of the present invention is to provide a bag-type liner especially adapted for use in combination with conventional bedpans but also usable with other devices, such as diapers or the like in which a disposable bag-type liner would be effective, with the liner being constructed of biodegradable plastic material capable of receiving and retaining human excrement with the entire liner and its contents being flushable such as by depositing the liner and its contents in a commode and flushing the commode so that the liner and its contents will be discharged into the sewage system with the material of the liner being degradable prior to reaching a sewage treatment plant or the like.

Another object of the invention is to provide a bag-type liner constructed so that it is folded into a substantially flat condition generally in the shape of the interior of a bedpan with tabs being attached to the open edge of the liner so that the tabs may be grasped and by pulling on the tabs, the open end portion of the liner may be pulled into overlying relation to the supporting flange on the bedpan with the remainder of the liner being extended by hand pressure exerted interiorally thereof, thus generally conforming the liner with the interior of the bedpan with all portions of the bedpan being engaged by a patient or occupany being covered by the liner, thereby maintaining aseptic conditions.

A further object of the invention is to provide a bag-type liner in accordance with the preceding objects in which the tabs provided on the liner are adhesively coated on one surface thereof for secure engagement with the exterior surface of the bedpan adjacent the bottom thereof and against the exterior surface of the bottom of the bedpan thereby retaining the liner securely in position during use and enabling removal of the liner by disengaging the tabs whereby the tabs become a handle to facilitate the removal of the liner from the bedpan and facilitate handling of the liner and its contents when positioning the same in a commode or the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
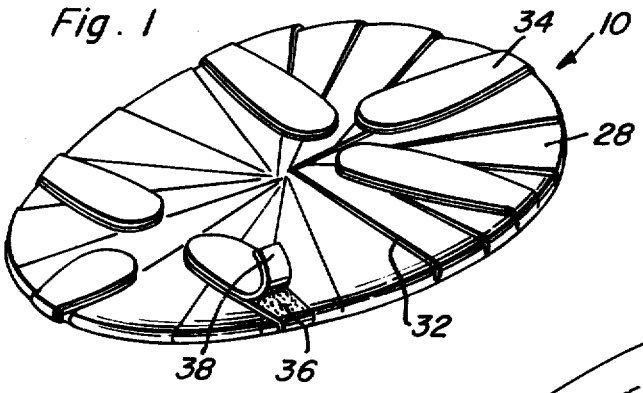
FIG. 1 is a perspective view of the bag-type liner in its folded, compact condition prior to insertion into a bedpan.

The bag-type liner of the present invention is generally designated by reference numeral 10 and is illustrated in use in combination with a conventional bedpan generally designed by reference numeral 12 in which the bedpan is conventional in construction and includes a generally flat bottom 14, an upstanding peripheral wall 16 and an inturned and downwardly sloping top wall 18 which forms a support for a person using the bedpan in a well known manner. The inturned supporting flange 18 is omitted at the front and is downwardly inclined and may be slightly concavely curved on its upper surface and provided with a generally oval shape configuration and insofar as the present invention is concerned, the bedpan is conventional in every respect.

Figure 3:
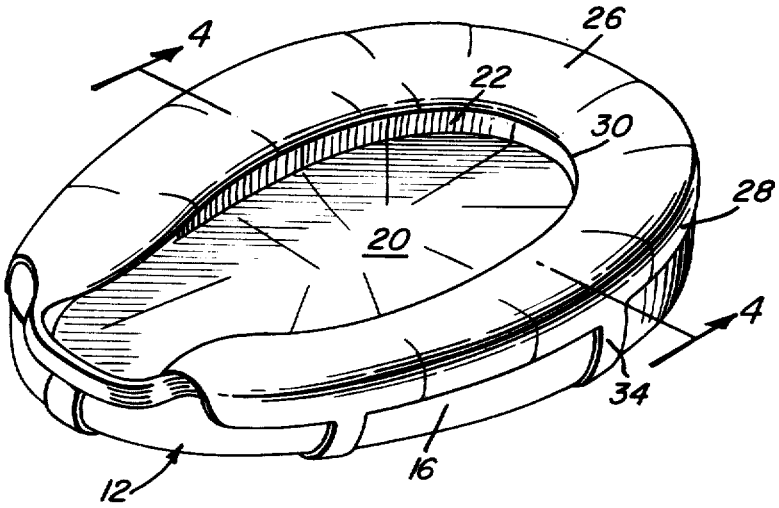
FIG. 3 is a perspective view of the liner and bedpan in assembled condition with the assembly ready for use.

The liner 10 is in the form of a bag like structure having a bottom panel 20, upwardly extending peripheral wall portions 22 and top portions 24 and 26 in which the top portion 24 is disposed generally in underlying relation to a portion of the flange 18 and the top portion 28 is disposed in overlying relation to the flange 18 and extends peripherally beyond the flange 18 so that the edge portion 28 of the top 26 extends downwardly along the outer surface of the upper portion of the peripheral wall 16 as illustrated in FIG. 3. The juncture between the top portion 24 and 26 defines an entrance opening 30 which coincides with the inner edge of the flange 18 and is shaped in a manner that it will also cover the top edge of the forward portion of the peripheral wall 16 where the top flange 18 has been omitted.

Figure 2:
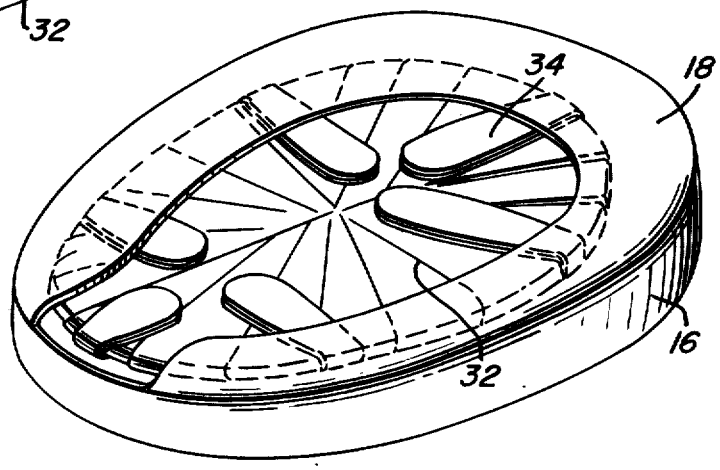
FIG. 2 is a perspective view of a bedpan with the liner of the present invention inserted therein prior to the liner being unfolded into an assembled condition.
Figure 4:
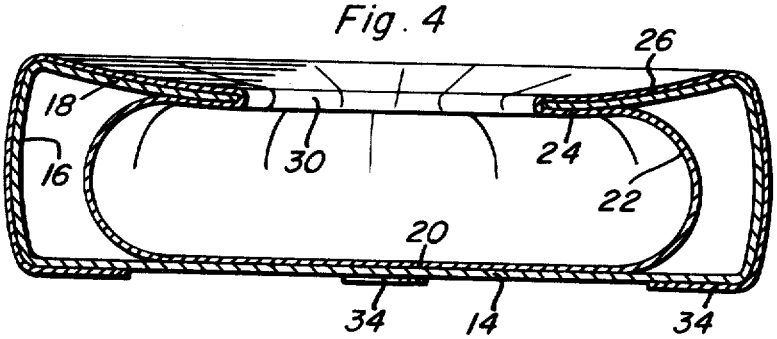
FIG. 4 is a transverse, sectional view taken substantially upon a plane passing along section line 4—4 of FIG. 3 illustrating the associational relationship of the liner with the bedpan.

The main body portion of the liner is folded in a manner that it is substantially flat and has a general oval shape configuration generally similar to the overall configuration of the bedpan so that the liner may be stored in a substantially flat condition with the plarality of radial fold lines 32 therein with tabs 34 being provided on the peripheral edge of the liner 10 with the tabs being integral therewith and normally disposed in overlying relation to the main body of the liner 10 as illustrated in FIG. 1. When the line 10 is to be used, the liner is inserted into the interior of the bedpan as illustrated in FIG. 2 with the tabs 34 being disposed upwardly and oriented so that the fixed tabs on the liner are accessible through the open upper portion of the bedpan. Then by grasping the tab or tabs at one side of the liner with one hand and forcing the center part of the liner downwardly, the peripheral edge 28 of the liner will be drawn upwardly through the open upper end of the bedpan and into overlying relation to the top surface of the flange 18. As the peripheral edge 28 is pulled downwardly over a portion of the peripheral wall 16, the tab 34 is used to secure the peripheral edge of the liner in place by virtue of an adhesive coating 36 which is protected by a removable cover sheet 38. The tabs are usually oval shape in configuration and the adhesive coating 36 is on the surface thereof which will engage the external surface of the bedpan thereby securing the peripheral edge 28 of the liner in overlying relation to the peripheral wall portion of the bedpan so that the liner will cover the flange 18 and the upper edge of the portion of peripheral wall of the bedpan at the far end thereof where the flange 18 has been omitted. During the progressive movement of the tabs by using one hand, the other hand will be used to unfold and shape the liner so that it generally conforms with the interior configuration of the bedpan with final assembly of the liner with the bedpan as illustrated in FIGS. 3 and 4.

The bag or line 10 is constructed of bio-degradable plastic material such as hydroxypropyl cellulose or other bio-degradable material which will contain human excreta for several hours and then can be flushed through normal hospital facilities such as a commode or the like since the bag can be flushed in cold water and be decomposed by the cold water, thus enabling complete degradation through plumbing systems without clogging. The adhesive material on the tabs and the cover therefor has sufficient anchoring characteristics to maintain the liner in position during use but yet enable easy removal of the tabs and the liner from the bedpan after use. The folded or closed position of the bag illustrated in FIG. 1 includes folded and overlapping creases extending to the center of the bag which enables the bag and oppositely positioned tabs to be used to pull the peripheral edge of the liner up through the bedpan opening while at the same time forcing the center and central portions of the liner downwardly and into underlying relation to the bedpan flange, thus enabling installation of the liner without contact with the bedpan, and since the tab extends under the bedpan, when a patient is on the bedpan in a conventional position, the weight of the occupant actually will serve to facilitate the tabs holding the liner in position since the tabs will be securely locked to the bedpan by the adhesive and by the downward pressure exerted by the occupant of the bedpan. The accordian-like circular creasing enables the tabs to be used to move the peripheral edge of the bedpan liner outwardly as the diaphragm-like creases open, and even if the bottom portion of the liner is not fully extended in contact with the bedpan, any material disposed therein by the occupant will cause the liner to extend into conformation with the interior of the bedpan.

The bag or liner may be varied in size and shape depending upon its use and may also be utilized as a liner for portable urinals, diapers, drainage bags, sanitary napkins or pads and the like or in any other location where a disposal bag-type liner is desired for waste material which can be disposed of by flushing the bag and its contents down a commode into the plumbing system where the bag will decompose, thus avoiding any possibility of the plumbing system becoming clogged. The use of the bag or liner materially facilitates the maintenance of aseptic conditions in hospitals and the like and materially reduces the burdensome job of emptying and cleaning bedpans.

The foregoing is considered as illustrative only of the principles of the invention. Further, since numerous modifications and changes will readily occur to those skilled in the art, it is not desired to limt the invention to the exact construction and operation shown and described, and accordingly all suitable modifications and equivalents may be resorted to, falling within the scope of the invention.

What is claimed as new is as follows:

1. A bag-type liner for bedpans comprising a body adapted to be positioned within a bedpan and covering the interior thereof, said body including an outwardly extending edge portion adapted to overlie and cover the inwardly extending flange on a bedpan, and anchoring means on the outwardly extending edge portion for engaging the bedpan for securing the liner thereto, said body including the outwardly extending edge portion and the anchoring means thereon being constructed of bio-degradable material to enable the liner and its contents to be flushed into a sewage system without clogging, said body and outwardly extending edge portion being folded into a generally planar condition for storage and for initial insertion into the interior of a bedpan with the body being folded by the provision of a plurality of radially extending overlapping creases defining an accordian fold structure which facilitates peripheral enlargement of the body into conformity with the interior of a bedpan when extended.

2. The structure as defined in claim 1 wherein said anchoring means are in the form of a plurality of radially extending tabs on the peripheral edge of the outwardly extending edge portion of the body, each of said tabs including an adhesive coating on one surface thereof for anchoring the tabs and the peripheral edge portion of the body to the exterior of the bedpan.

3. The structure as defined in claim 1 wherein each of said tabs is of oval shaped configuration, provided with a covering for the adhesive surface which is removable and being of a length to extend under the bedpan so that downward pressure exerted on the bedpan by an occupant will exert downward pressure on the tabs thereby securing the tabs and the liner more securely to the bedpan.

4. In combination, a bedpan of rigid construction having a bottom, upstanding peripheral wall and inwardly extending occupant supporting flange defining an open upper end for receiving human excreta, a disposable bag conforming to and forming a liner for the interior of the bedpan and a cover for the occupant supporting flange thereon, means on the peripheral edge of the bag anchoring the peripheral edge of the bag to the exterior of the bedpan with the peripheral edge of the bag being disposed against a portion of the peripheral wall of the bedpan below the flange thereby completely covering the flange on the bedpan, said bag being constructed entirely of bio-degradable material capable of holding human excreta for a predetermined time period and becoming decomposed when flushed down a commode without clogging the sewage system said bag being folded into a generally planar condition for storage and for initial insertion into the interior of the bedpan with the bag being folded by the provision of a plurality of radially extending overlapping creases defining an accordian fold structure which facilitates peripheral enlargement of the bag into conformity with the interior of the bedpan when extended.

5. The combination as defined in claim 4 wherein said means on the peripheral edge of the bag include a plurality of adhesively coated tabs of unitary construction with the bag, each of said tabs extending under the bedpan and adhesively secured thereto whereby downward pressure on the bedpan by an occupant will further anchor the tabs to the bedpan.

* * * * *